United States Patent [19]

Lacroix et al.

[11] 4,422,488

[45] Dec. 27, 1983

[54] MACHINE FOR PRODUCING DRAWER-SIDES

[75] Inventors: Paul H. Lacroix, Ste-Foy; Ernest Lacasse, St-Romuald, both of Canada

[73] Assignee: Centre de Recherche Industrielle du Quebec, Quebec, Canada

[21] Appl. No.: 300,481

[22] Filed: Sep. 9, 1981

[51] Int. Cl.[3] ..... B27M 3/18; B27C 9/04; B27F 1/02; B27F 1/08

[52] U.S. Cl. ..... 144/368; 144/369; 144/3 L; 144/41

[58] Field of Search ..... 144/2 C, 3 L, 39, 41, 144/2 R, 3 R, 367, 368, 369, 118, 117 B, 117 R, 133; 83/408, 407, 871, 788, 431; 198/406, 456

[56] References Cited

U.S. PATENT DOCUMENTS

| | | | |
|---|---|---|---|
| 517,348 | 3/1894 | Linderman | 144/368 |
| 691,267 | 1/1902 | Hill | 144/117 B |
| 1,121,706 | 12/1914 | Wysong | 144/86 |
| 1,122,350 | 12/1914 | Wysong | 144/85 |
| 1,245,240 | 11/1917 | Kelly | 144/85 |
| 1,771,888 | 6/1929 | Goff | 144/2 R |
| 1,976,171 | 10/1934 | Hutchings | 83/871 |
| 2,586,798 | 2/1952 | Eck | 144/87 |
| 2,593,744 | 4/1952 | Gillespie | 144/3 R |
| 2,607,375 | 8/1952 | Gillespie | 144/87 |
| 3,483,904 | 12/1969 | Jacomin | 144/3 R |
| 3,547,171 | 12/1970 | Jacumin | 144/325 |
| 3,841,367 | 10/1974 | Vizziello et al. | 144/39 |
| 4,015,648 | 4/1977 | Shepard | 144/39 |
| 4,074,737 | 2/1978 | Stewart | 144/117 R |
| 4,127,153 | 11/1978 | Cipollone | 144/3 R |
| 4,265,354 | 5/1981 | Sinnema | 198/406 |
| 4,269,245 | 5/1981 | Fornell et al. | 198/456 |

FOREIGN PATENT DOCUMENTS

| | | | |
|---|---|---|---|
| 520952 | 3/1955 | Italy | 83/407 |

*Primary Examiner*—Francis S. Husar
*Assistant Examiner*—Jorji M. Griffin
*Attorney, Agent, or Firm*—Cushman, Darby & Cushman

[57] ABSTRACT

The machine described in this disclosure serves to produce pairs of drawer sides from a panel, the thickness of which is slightly more than twice the thickness of one drawer-side; a first arrangement of saws cuts the panel to a predetermined drawer-side height; while a second arrangement of saws cuts off the panels to a predetermined drawer-side length; by means of conveyors, the panels are then passed to a band-saw which slits each panel, through its thickness, into two boards of substantially equal dimensions; two tables each receive a board laid flat, the lower surface of each board being planed by a series of cutters, the sides being machined by a second series of cutters, and the upper surface being planed and grooved by a third series of cutters; the boards are then brought together on a machining table where horizontal and vertical dovetailing heads form a male dove-tail at the end of the drawer-side and a female dove-tail on the upper surface of the drawer-side.

20 Claims, 9 Drawing Figures

Fig. 8
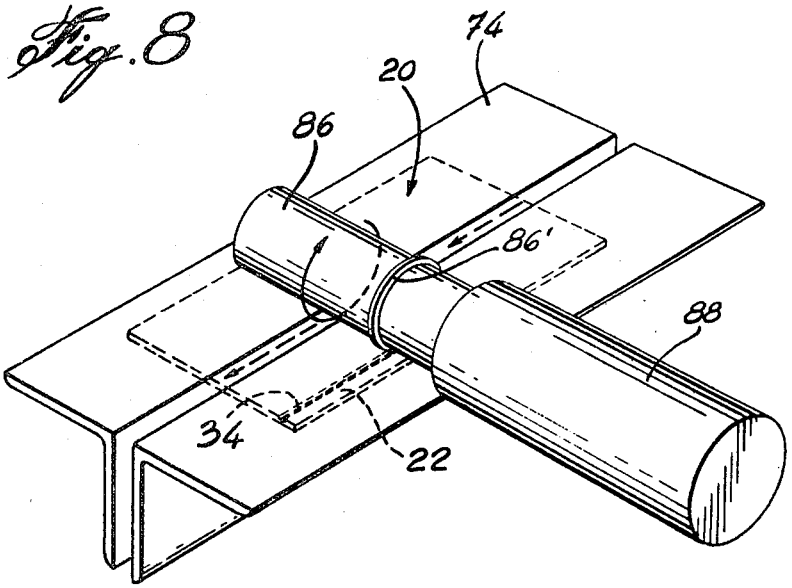
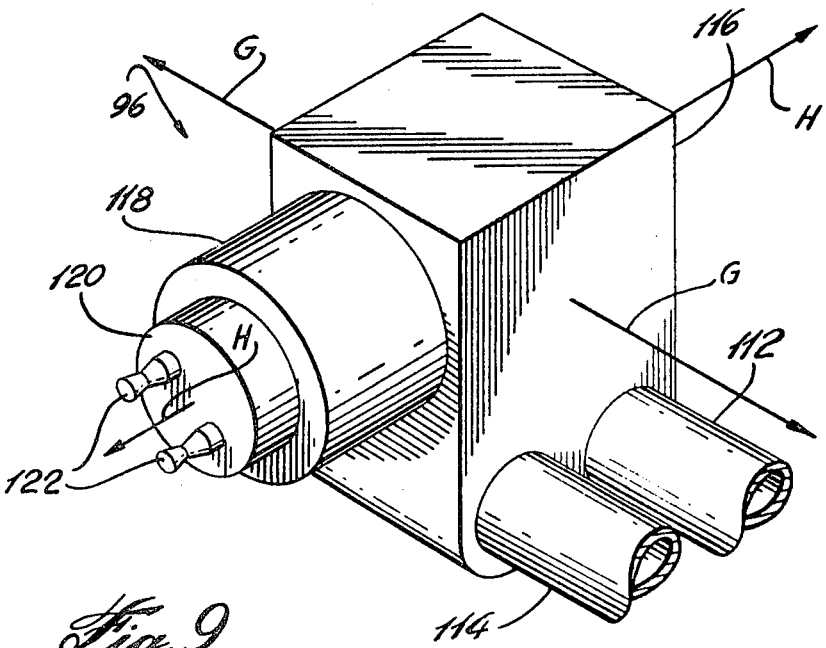
Fig. 9

MACHINE FOR PRODUCING DRAWER-SIDES

The present invention relates to a machine for mass-producing pairs of drawer-sides; the invention also relates to a method for producing drawer-sides.

Drawer-sides have, until now, been produced in several separate operations involving a fair number of conventional machines. This has resulted in considerable handling between each operation and in storage, often highly inconvenient, between production stages. The use of a series of separate machines also has other disadvantages, such as the amount of floor space required and the time required to set-up each machine.

It is an object of the present invention to provide a machine which combines the operations needed to produce drawer-sides and to carry them out continuously. Continuous operation reduces handling and storage between production stages is eliminated. Floor space is also reduced and setting-up time is obviously shorter.

The present invention therefore relates to a machine for mass-producing pairs of drawer-sides from a panel, the thickness of which is slightly greater than twice the thickness of one drawer-side. This machine comprises: a first sawing means used to cut the panel to a predetermined drawer-side height; a second sawing means used to cut the panels to a predetermined drawer-side length; a third sawing means used to cut through the thickness of the panels in order to produce two boards of substantially equal dimensions; a smoothing table to which the two separate boards are fed flat, the table comprising means for planing the two surfaces, upper and lower of each board, as well as the longitudinal edges thereof; means used to move the two boards towards each other; and a machining table comprising horizontal and vertical dove-tailing heads adapted to produce at one end of each of the two boards a male dove-tail and, on the upper surfaces thereof, a female dove-tail.

The present invention also relates to a method for continuous production of pairs of drawer-sides; this method consists in: cutting the panels by means of saws to a predetermined drawer-side height; cutting the panels, by means of saws, to a predetermined drawer-side length; cutting through the thickness of the panel in order to produce two boards of substantially equal dimensions; placing each of the boards flat upon separate tables in order to smooth the lower surfaces, to machine the sides, to plane the upper surfaces, and to produce longitudinal grooves; bringing the two boards together; and machining in a single operation, by means of a horizontal dove-tailing head, a male dove-tail in one end of the two boards and, by means of a vertical dove-tailing head, a female dove-tail in the upper surfaces of the boards.

Other characteristics and advantages of the invention may be gathered from the following description of an example of an embodiment of a machine for producing drawer-sides, in conjunction with the drawing attached hereto, wherein:

FIG. 8 is a diagrammatical perspective view of an helicoidal bit comprising a grooving device;

FIG. 9 is a diagrammatical perspective view of a horizontal dove-tailing head.

Figure 1:
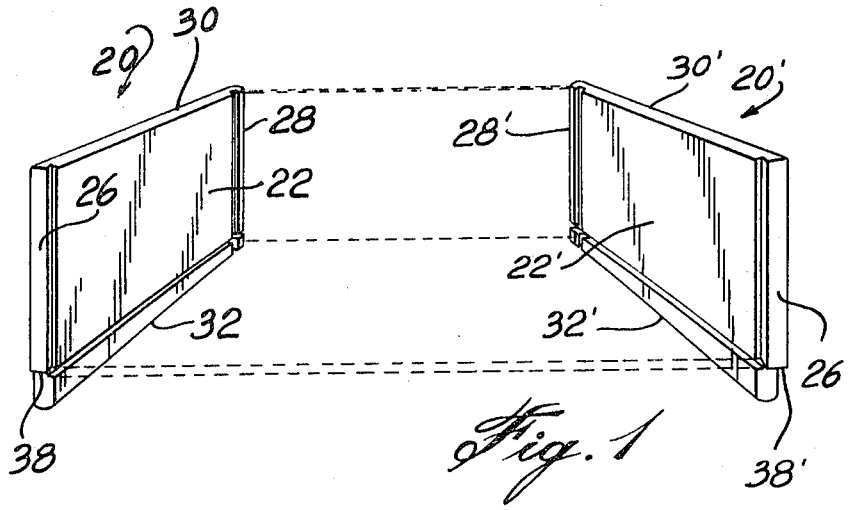
FIG. 1 is a perspective view of the two sides of a drawer produced by the machine and method according to the present invention.
Figure 2:
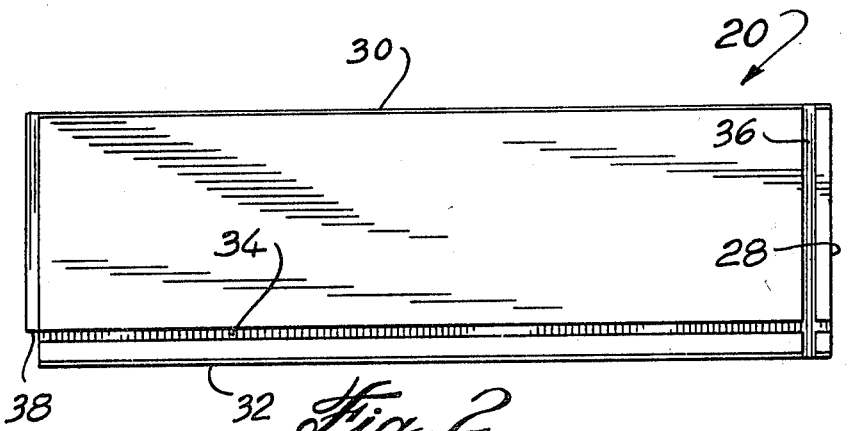
FIG. 2 is a side elevation of the internal surface of the drawer-side.
Figure 3:
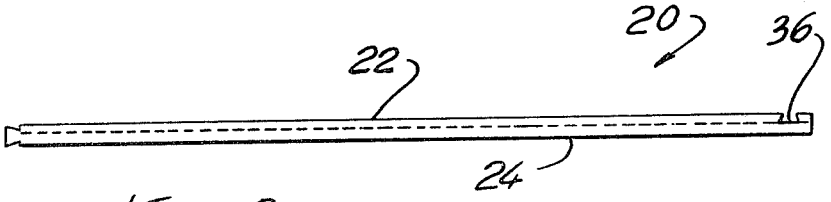
FIG. 3 is a view of a drawer-side from below

The apparatus and method according to the present invention relate to the production of the two drawer-sides represented in FIG. 1 by boards 20,20'. The design of one board is a mirror-image of that of the other and comprises an internal surface 22 and an external surface 24, two lateral edges 26, 28 to be arranged respectively at the front and back of the assembled drawer, and two longitudinal edges, the upper marked 30 and the lower 32. Internal surface 22 of board 20 comprises a longitudinal groove running parallel with lower edge 32 and a second, female, dove-tail groove running parallel with rear lateral edge 28. Front lateral edge 26 of the drawer-side is finished with a male dove-tail, the lower part of which, on a level with groove 34, is notched Board 20' is of the same design as board 20; the reference numeral relating to board 20' are the same as those relating to board 20, but are identified by the use of a prime symbol.

Figure 4:
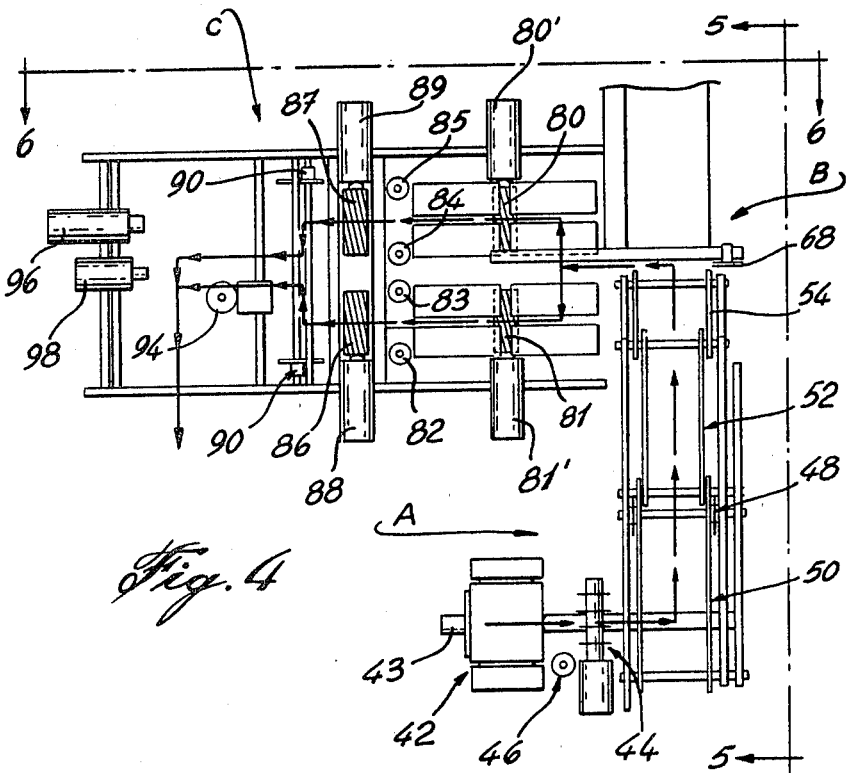
FIG. 4 is a plan view indicating diagrammatically the method of producing the two drawer-sides from one panel, and showing the different components of the machine.
Figure 5:
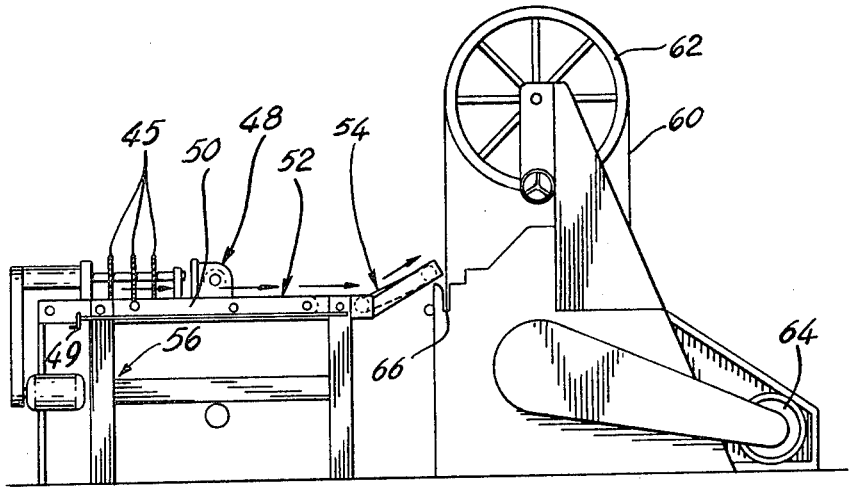
FIG. 5 is a diagrammatical side elevation of the apparatus along line 5—5 in FIG. 4.
Figure 6:
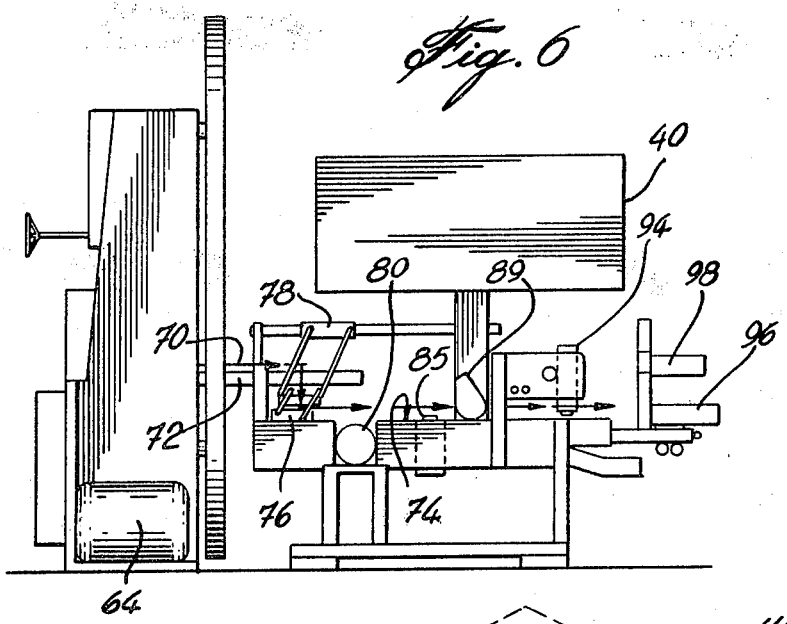
FIG. 6 is a diagrammatical side elevation of the apparatus along line 6—6 in FIG. 4.

Referring now to FIGS. 4, 5 and 6, the machine which produces drawer-sides 20,20' consists of three main parts: a sawing part A, a slitting part B, and a machining part C. These three parts are connected to a central control-panel 40 (FIG. 6) through which pass all electrical, pneumatic and hydraulic controls for manual or automatic operation of the machine. Also located on this panel is a programmable automatic unit controlling the operational sequences. Since this control-panel is not an essential part of the invention, it will not be described herein.

Sawing part A consists of a magazine 42, multiple saws 44, a chopper 46, a cut-off unit 48, and three conveyors 50, 52, 54.

Magazine 42 is designed to accommodate a number of panels which may be made up from glued remains of planed wood. These panels may be stacked horizontally in the magazine which comprises a feedcylinder used to push the lowermost panel of the stack towards the multiple saws 44. Although not shown, a lateral pusher is used to keep the panels to be cut pressed to the same side of the magazine.

The panels pass from the magazine, one by one, through the multiple saws 44 which cut them to the desired height. Saws 44 consist of a variable number of circular saws depending upon the height of the drawer-sides to be produced. Located above the circular saws are guards 45 (one for each saw) which recover the wood-dust and serve, at the same time, as hold-downs. Located at the side of the machine, and slightly before the axis of the multiple saws, is a vertical chopping head, with lateral adjustment, which reduces to chips any wood remaining after a panel has passed through the multiple saws.

Mounted upon a shaft, the axis of which is at 90° to the axis of multiple saws 44, are two circular saws 48, one of which is adapted to slide on the shaft in order to adapt to variations in the length of the drawersides. Arranged outside each of these saws are chopping blades used to convert into chips any wood left over from cut-off saws 48. Located above each of these saw blade chopping units is a saw-guard which recovers the wood-dust and acts as a hold-down.

Mounted in a single structure 56 are three conveyors, all of them laterally adjustable, at the same time as cut-off saws 48, from one and the same controlpoint 49, namely feed-conveyor 50 for the cut-off saws, waiting conveyor 52 after the cut-off operation, and transfer conveyor 54 which feeds one piece at a time to slitting part B.

This part consists mainly of a band-saw 60 running over two wheels, one of which is shown at 62 and is driven by a motor 64. The panel lying flat on conveyor 54 falls vertically into a channel 66. By means of a pusher 68 it is pressed against the band-saw and is sawn through its thickness to produce two boards of substantially equal dimensions. The boards thus sawn are guided on a support 72 which holds them vertical over a certain distance; thereafter, two plungers (not shown) cause the boards to slide flat upon a machining table 74 in such a manner that the sawn surfaces are directed downwardly. By means of photoelectric cells (not shown), the arrival of the two boards is detected; they are both positioned laterally and longitudinally by suitable means, such as pneumatic guides and pushers, which are not described in detail since they are not essential parts of the present invention. Hold-downs 76 descend onto each board. An hydraulic cylinder 78 imparts a longitudinal motion to hold-downs 76, carrying the two boards through a first pair of vertically adjustable helicoidal cutters 80, 81; these are actuated by motors 80' and 81' respectively, thus smoothing the lower surface of each of the boards. The machining table also carries four vertical heads used to machine longitudinal sides 30,32 of each of the boards. The machining table also comprises a second pair of helicoidal cutters used to plane upper surface 22 of the boards. These cutters are mounted directly above electric motors 88, 89 and are vertically adjustable in order to determine the thickness of the drawer-side.

Figure 7:
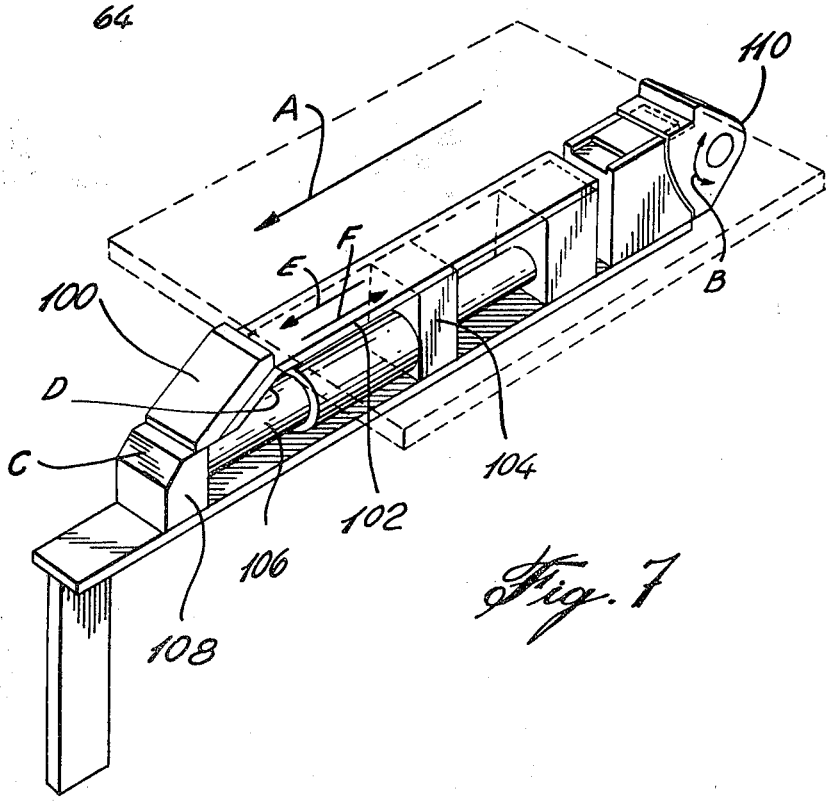
FIG. 7 is a diagrammatical perspective view of a driving vise used in the machine of the present invention.

In order to feed the boards through the vertical heads and then through the planers, driving vises (see FIG. 7) are provided to ensure that the boards are not "swallowed" as they advance under the cutters. These vises are located between smoothing stations 80, 81 and vertical heads 82, 83 or 84, 85. A mobile jaw 100 is shown in the closed position. In order to reach the open position, the jaw is moved in direction "E" by a spring blade 102, a driving block 104, and a piston 106. The mobile jaw slides horizontally against the top of bracket 108 until inclined plane "D", under spring blade 102, engages with inclined plane "C" on bracket 108. Jaw 100 then starts to move downwardly so that, as it opens, it retracts below the surface of the table, since this is required for a subsequent operation. With mobile jaw 100 open, the drawer-sides reaching the smoothing station cause rocking jaw 110 to descend and assume its normal position, by spring action, as soon as the wood is no longer in contact therewith. The mechanisms previously described then return mobile jaw 100 to the closed position, in the direction of arrow "F", thus clamping the drawer-side against rocking jaw 110.

Helicoidal cutters 86, 87 also have a grooving blade 86' (see FIG. 8) which produces longitudinal groove 34 on upper (inner) surface 22 of each board. Cutters 86,87 are also adjustable transversely for the purpose of positioning the groove in accordance with the width of the drawer-side to be produced.

After the two boards have been planed, they are moved to the centre of the machining table on each side of a tongue, acting as a guide and stop, by approach-cylinders 90 supported above the table. Mounted above the machining table, a first vertical dove-tailing head 94 moves transversely producing, in a single movement, female dove-tails 36 in the two wooden boards. At the end of the machining table, a horizontal dove-tailing head 96 is mounted in a manner such as to produce, in a single movement, a male dove-tail 26 on the front ends of the two drawer-sides. Dove-tailing mechanisms 94,96 travel together on the machining table in order to produce the desired configurations on the wooden boards. A notching head 98 is mounted to move vertically for the purpose of producing notches 38 simultaneously on each of the two boards. This notching head moves back as soon as the notch has been made, to allow dove-tailing head 96 to return to its initial position. During the return movement of dove-tailing heads 94,96, a system engages the two boards and ejects them from the machining table.

With reference to FIG. 9, dove-tailing mechanism 96, having a horizontal head, comprises a drive-cylinder 112 and a support 114 arranged in parallel, holding a block 116 and guiding it in a bi-directional movement in the direction of axis "G". Secured to block 116 is motor 118 which is adjustable in the direction of axis "H". Mounted on one end of motor 118 is a gearbox 120 which can be oriented clockwise or anticlockwise about axis "H". This movement allows two dove-tailing cutters 122 to move towards or away from the horizontal axis of motor 118 and thus to generate a more or less thick, male dove-tail.

For automatic operation of the machine, the operator must make sure first of all that all movements are in their starting positions. The operator then loads magazine 42 with panels. The presence of the wood is detected and the lateral pusher advances to guide the first panel while it is being pushed through chopping head 46, and multiple saws 44, by drive-cylinder 43. The sawn pieces reach conveyor 50 which feeds cut-off saws 48. Detection of the pieces signals the conveyor to make a half turn, thus carrying all the pieces thereon through the cut-off saws, to waiting conveyor 52 which follows the cut-off saws and is in continuous operation. When the pieces of wood are detected upon the waiting conveyor, transfer conveyor 54 picks up one piece at a time and tips it into channel 66 on band-saw 60, in a position such that it can be slit in the direction of its thickness. When the piece of wood is detected in the band-saw channel, a hydraulic cylinder 68 pushes it through the band-saw which thus slits it. At the outlet from the band-saw, a mechanism positions the two pieces leaving the band-saw in a fairly accurate location upon smoothing table 74. Here they are detected by photoelectric cells and are held by pushers against adjustable lateral guides. Longitudinal positioners move the two pieces of wood to an accurate position on the smoothing table before hold-downs 76 descend. Thus guided and held, the two pieces of wood pass over halicoidal cutters 80,81 which plane the lower surface. Upon completion of the planing operation, and before the hold-downs are retracted, drive-vises pick up the two pieces of wood at the bottom and pass them through vertical heads 82,83,84,85 which machine the width of the drawer-side and chamfer the edges thereof. After passing the vertical heads, and without releasing their grips, the drive-vises continue to advance and pass the boards under two further helicoidal cutters 86,87 which machine upper surfaces 22,22' of the drawer-sides to their finished dimensions and, at the same time, groove these surfaces. Upon assembly, these grooves accommodate the bottom of the drawer. Thus, two sides of the drawer, the length, width and thickness of which are finished, are located on dove-tailing tables separated by two plungers and held by four pneumatic vises. With the two pieces thus positioned, vertical and horizontal dove-tailing heads 94,96 advance simultaneously and cut male dove-tails on one end and female dove-tails in the upper surfaces of the drawer-sides. When the dove-tailing heads are engaged in the second drawer-side, and while they continue on their path, notching head 98 descends and ascends rapidly, simultaneously removing a part of the male dove-tail over a predetermined length equal to the distance between groove 34 and lower edge 32. Once the notching head has returned to its starting position, and the dove-tailing heads have completed their forward movement, the four vises open, the plungers descend, and the dove-tailing heads return to their starting positions, ejecting the two drawer-sides which have just been machined.

The embodiments of the invention in which an exclusive property or privilege is claimed are defined as follows:

1. A machine for continuous production of pairs of drawer-sides from panels of a thickness slightly greater than twice the thickness of one drawer-side, said machine comprising:

a magazine accommodating said panels laid flat in a horizontal position;

first sawing means, adjacent said magazine, for cutting the panels successively to a predetermined drawer-side height;

second sawing means adjacent said first sawing means for cutting off each panel to a predetermined drawer-side length;

means adjacent said second sawing means for moving the panel into a vertical position;

third sawing means adjacent said moving means for slitting the panel in two, through its thickness, in order to obtain two boards of substantially equal dimensions;

a smoothing table adjacent said third sawing means receiving the two boards laid flat and separated from one another said table including means for planing the two surfaces, upper and lower, of each of the boards and the two longitudinal edges thereof;

means adjacent said smoothing table for bringing the two boards together;

a machining table adjacent said last mentioned means including horizontal and vertical dove-tailing heads for producing, at one end of the two boards, a male dove-tail and, upon the upper surfaces of said boards, a female dove-tail.

2. A machine according to claim 1, wherein said magazine is adapted to accommodate a series of panels arranged horizontally and is equipped with means for pushing said panels successively to said first sawing means.

3. A machine according to claim 2, wherein said first sawing means comprises a variable number of circular saws mounted upon one shaft and arranged over the width of the drawer-sides to be produced.

4. A machine according to claim 3, comprising a chopping head located on one side of the magazine and before the shaft of the circular saws, said chopping head being installed vertically and being adjustable laterally.

5. A machine according to claim 1, comprising a series of conveyors, at the outlet from the first sawing means, for directing the panels to the second and third sawing means; said second sawing means comprising two circular saws mounted upon a shaft; one of said two circular saws being adapted to slide along its shaft in order to take account of variations in the length of the drawer-sides.

6. A machine according to claim 5, wherein the conveyors are laterally adjustable.

7. A machine according to claims 3 or 5, wherein the shaft of the two circular saws extends at right angles to the shaft of the circular saws of the first sawing means.

8. A machine according to claim 5, wherein the conveyors arranged between the first and third sawing means comprise a conveyor feeding the two circular saws, a waiting conveyer downstream of the second sawing means, and a transfer conveyor allowing the panel to pass from a horizontal position thereon to a vertical position before reaching the third sawing means.

9. A machine for continuous production of pairs of drawer-sides from a panel of a thickness slightly greater than twice the thickness of one drawer-side, said machine comprising:

(a) first sawing means for cutting the panel to a predetermined drawer-side height;

(b) second sawing means adjacent said first sawing means for cutting off each panel to a predetermined drawer-side length;

(c) third sawing means adjacent said second sawing means for slitting each panel in two, through its thickness, in order to produce two boards of substantially equal dimensions;

(d) a smoothing table adjacent said third sawing means receiving the two boards laid flat and separated from one another, said table including means for planing the two surfaces, upper and lower, of each of the boards, and the two longitudinal edges thereof;

(e) means adjacent said smoothing table for subsequently moving the two boards towards each other;

(f) a machining table adjacent said moving means including horizontal and vertical dove-tailing heads for producing, at one end of the two boards, a male dove-tail and, on the upper surfaces of said boards, a female dove-tail.

10. A machine according to claim 9 or 1, wherein said third sawing means comprises a band-saw, a channel designed to receive the panel in a vertical position, and a feed system used to push the panel into said channel and to slit it into two boards.

11. A machine according to claim 9, wherein said planing means mounted upon the smoothing table comprise: a pair of helicoidal cutters, each used to plane the lower surface of each of the two boards, two pairs of vertical heads, each pair used to plane the longitudinal sides of each of the two boards, and a second pair of helicoidal cutters used to plane the upper surface of each of the two boards.

12. A machine according to claim 11, wherein the second pair of helicoidal cutters comprises a grooving part permitting the production of a longitudinal groove in the upper surface of each of the two boards.

13. A machine according to claim 9 or 1, comprising four pneumatic vises used to secure the boards during the machining of the male and female dove-tails.

14. A machine according to claim 9 or 1, wherein the dove-tailing heads are adjustable along two axes respectively.

15. A machine according to claim 9 or 1, comprising hydraulic cylinders driving the two dove-tailing heads.

16. A machine according to claim 9 or 1, comprising a notching head for removing a male dove-tail part from each of the two boards.

17. A method for continuous production of pairs of drawer-sides from a panel of a thickness slightly greater than twice the thickness of one drawer-side, consisting in: cutting the panels successively, by means of saws, to a predetermined drawer-side height; cutting the panels thus cut, by means of cut-off saws, to a predetermined drawer-side length; slitting the cut panels through their thickness in order to obtain two boards of substantially equal dimensions; laying the boards flat, separately, upon a smoothing table; planing separately the upper and lower surfaces, and the longitudinal edges, of the two boards and grooving the upper surfaces thereof in such a manner as to obtain a longitudinal groove in each board; bringing the two boards together; producing, in a single step and by means of a horizontal dove-tailing head, a male dove-tail at one end of the two adjacent boards and, by means of a vertical dove-tailing head, a female dove-tail in the upper surface of each board.

18. A method according to claim 17, consisting in directing the panels, after they have been cut, to three conveyors, namely one conveyor feeding the cut-off saws, one waiting conveyor downstream of said cut-off saws, and a transfer conveyor allowing the panel to pass from a horizontal position thereon to a vertical position prior to slitting.

19. A method according to claim 17, consisting in using hold-downs for the purpose of securing the boards to the smoothing table while the lower surfaces thereof are being planed.

20. A method according to claim 17, consisting in notching, in a single step, the male dove-tails at one end of each of the two boards.

* * * * *